US008011889B1

(12) United States Patent
Liang

(10) Patent No.: US 8,011,889 B1
(45) Date of Patent: Sep. 6, 2011

(54) TURBINE BLADE WITH TRAILING EDGE TIP CORNER COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1033 days.

(21) Appl. No.: 11/900,037

(22) Filed: Sep. 7, 2007

(51) Int. Cl.
*F01D 5/20* (2006.01)

(52) U.S. Cl. ..... 416/97 R; 415/173.1; 416/228

(58) Field of Classification Search ..... 415/173.1; 416/92, 97 R, 228
See application file for complete search history.

(56) References Cited

U.S. PATENT DOCUMENTS 3,635,585 A * 1/1972 Metzler, Jr. ..... 416/96 R
4,424,001 A * 1/1984 North et al. ..... 416/92
5,464,479 A 11/1995 Kenton et al.
5,503,527 A * 4/1996 Lee et al. ..... 416/91
5,564,902 A 10/1996 Tomita
5,738,491 A * 4/1998 Lee et al. ..... 415/177
6,039,531 A * 3/2000 Suenaga et al. ..... 415/115
6,652,235 B1 11/2003 Keith et al.
6,733,232 B2 * 5/2004 Ingistov et al. ..... 415/115
6,824,359 B2 11/2004 Chlus et al.
6,923,623 B2 * 8/2005 Cleveland et al. ..... 416/97 R

* cited by examiner

*Primary Examiner* — Nathaniel Wiehe
(74) *Attorney, Agent, or Firm* — John Ryznic

(57) ABSTRACT

A turbine blade for use in an industrial gas turbine engine, especially for the first stage turbine blade, in which the blade includes a squealer tip with a pressure side tip rail extending all the way top the trailing edge of the tip and a suction side tip rail with a cut back adjacent to the trailing edge to form a cooling air flow path from the squealer pocket and up and over the cut back in the suction side tip rail. The floor of the squealer pocket includes a series of skewed trip strips in the location of the cut back in the tip end, the trip strips being skewed in a direction to direct the cooling air toward the cut back. Rows of film cooling holes extend along the pressure and suction sides of the blade just below the tip rails to provide cooling for the tip rails. Tip cooling holes are located on the squealer pocket floor upstream from the trip strips and along the tip rail walls to provide cooling within the pocket. The skew trip strips begin just upstream from the cut back and extend along the pocket toward the tip end, extending substantially from the pressure side tip rail to the suction side tip rail.

15 Claims, 4 Drawing Sheets

TURBINE BLADE WITH TRAILING EDGE TIP CORNER COOLING

BACKGROUND OF THE INVENTION

1. Field of the Invention

The present invention relates generally to a gas turbine engine, and more specifically to a cooled turbine rotor blade with trailing edge tip corner cooling.

2. Description of the Related Art Including Information Disclosed Under 37 CFR 1.97 and 1.98

In an industrial gas turbine engine, a turbine section with a plurality of stages includes rotor blades and stator vanes to extract energy from a hot gas flow that is passed through the turbine to drive the rotor shaft. It is well known in the art of gas turbine engines that the engine efficiency can be increased by increasing the temperature of the hot gas flow entering the turbine. However, the highest temperature is limited to the material characteristics of the turbine parts, especially the first stage turbine stator vanes and rotor blades because these are directly exposed to the hot gas flow exiting the combustor.

Also in an industrial gas turbine engine (IGT), the longevity of the parts is an important design factor since these engines generally run for over 48,000 hours before shut down and inspection of parts. Any premature shutdown caused by a damaged part such as a turbine blade will result in significant increases in engine operating cost.

A first stage turbine rotor blade is exposed to the hot gas flow. A complex arrangement of internal cooling passages is used to provide cooling to the blade such that the blade can be used under extreme thermal conditions that would normally melt parts of the blade. Hot spots can occur on parts of the blade due to low levels of cooling. Hot spots can cause erosion of blade parts that will result in loss of efficiency to the engine and damaged parts that must be replaced. FIG. 1 shows a prior art conical turbine blade with a suction side cut back tip rail having a tapered tip rail tip corner.

One major problem with the prior art first stage turbine blade is in the blade trailing edge tip section. The prior art pressure side bleed tip rail design yields a suction side tip rail region which is very difficult to cool. High temperature turbine blade tip section heat load is a function of the blade tip leakage flow. A high leakage flow will induce a high heat load onto the blade tip section. thus, blade tip section sealing and cooling must be addressed as a single problem. The prior art turbine blade tip includes a squealer tip rail which extends around the perimeter of the airfoil flush with the airfoil wall to form an inner squealer pocket. The main purpose of incorporating a squealer tip in a blade design is to reduce the blade tip leakage and also to provide for rubbing capability for the blade against an outer shroud.

FIG. 2 shows a prior art blade squealer tip cooling design. Film cooling holes are formed along the airfoil pressure side tip section from the leading edge to the trailing edge of the blade to provide edge cooling for the blade pressure side squealer tip. Also, convective cooling holes are formed in the tip rail at an inner portion of the squealer pocket to provide additional cooling for the squealer tip rail. Secondary hot gas flow migration around the blade tip section is also shown by the arrows in FIG. 2. U.S. Pat. No. 5,564,902 issued to Tomita on Oct. 15, 1996 and entitled GAS TURBINE ROTOR BLADE TIP COOLING DEVICE discloses this squealer tip design.

FIG. 3 shows an enlarged view for the blade trailing edge squealer tip section of FIG. 2. Since the blade tip rail is cut off at the aft section of the pressure side (the tip rail on the pressure side does not extend all the way to the trailing edge), it becomes a single squealer tip rail configuration and thus decreases the ability to reduce the blade tip leakage flow. The suction side blade tip rail is subject to heating from three exposed sides. As a result, cooling of the suction side squealer tip rail from the row of film cooling holes along the blade pressure side peripheral and at the bottom of the squealer floor becomes insufficient. This is primarily due to the combination of squealer pocket geometry and the interaction of hot gas secondary mixing. The effectiveness induced by the pressure film cooling and tip section convective cooling holes is very limited. Therefore, for the blade trailing edge tip section, the prior art pressure side bleed tip rail design yields a suction side tip rail region which is very difficult to cool. Oxidation and erosion at the blade trailing edge suction side tip section occurs in most engine operations. Frequently this region of the blade tip needs to be rebuilt during engine overhaul cycles. This limits the life of the engine part and decreases the efficiency of the engine.

It is therefore an object of the present invention to provide for a turbine blade with a squealer tip having a trailing edge tip corner with increased cooling capability over the cited prior art references.

BRIEF SUMMARY OF THE INVENTION

The blade tip leakage flow and cooling problems of the prior art turbine blade can be reduced by incorporating the sealing and cooling geometry into the airfoil trailing edge tip corner design. Instead of the airfoil with a pressure side cut back, the pressure side tip rail will remain in place at the same height as the pressure side tip rail at the forward section. a suction side cut back with a tapered tip rail construction plus a built in radial convective cooling holes and skew trip strips located along the squealer pocket floor centerline are used to resolve these sealing and cooling problems for the blade trailing edge tip section. The cooling design of the present invention can be used in any conical high temperature industrial turbine application.

DETAILED DESCRIPTION OF THE INVENTION

Figure 1:
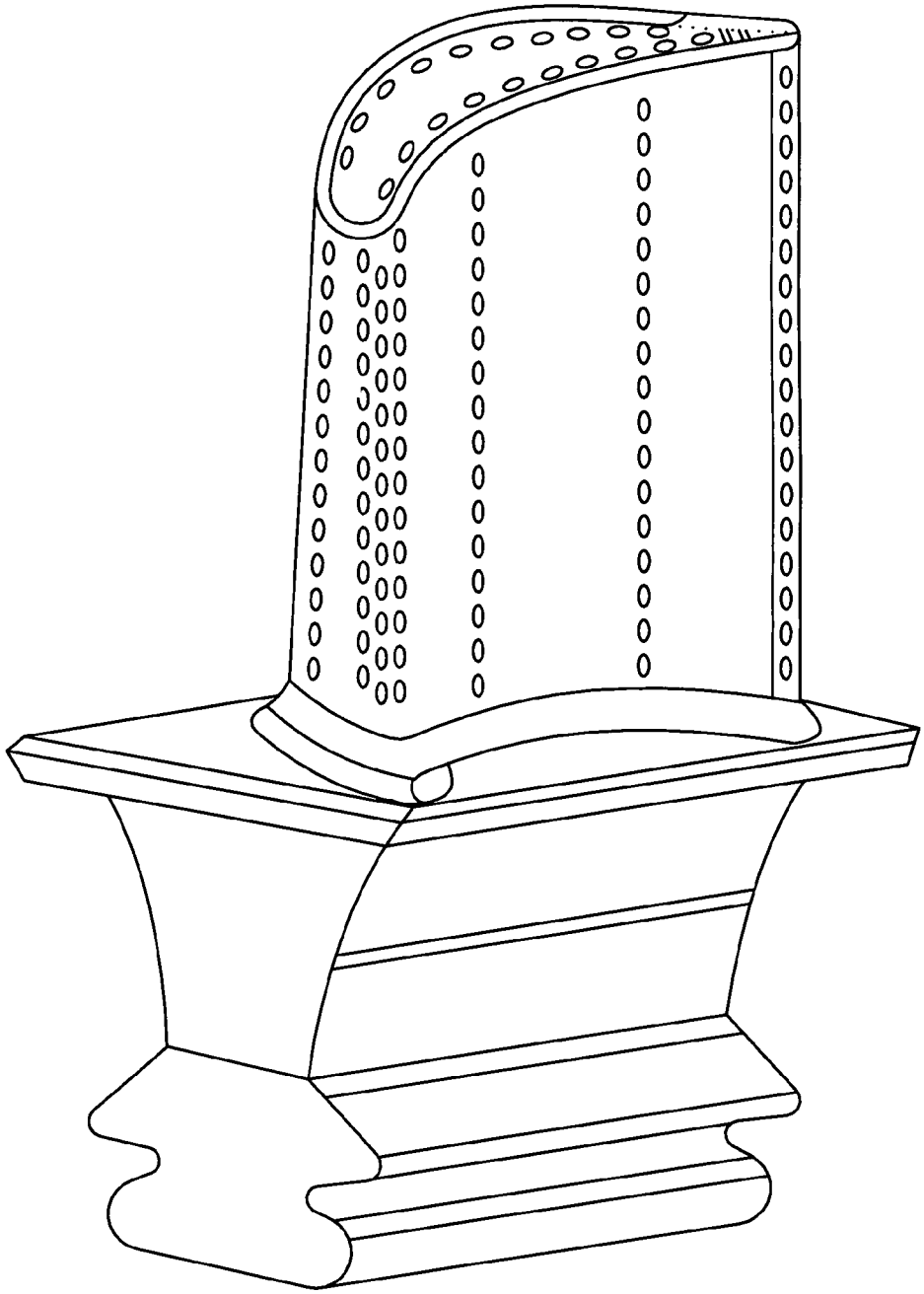
FIG. 1 shows a schematic view of a turbine blade with the suction side cut back tip rail construction of the present invention.
Figure 2:
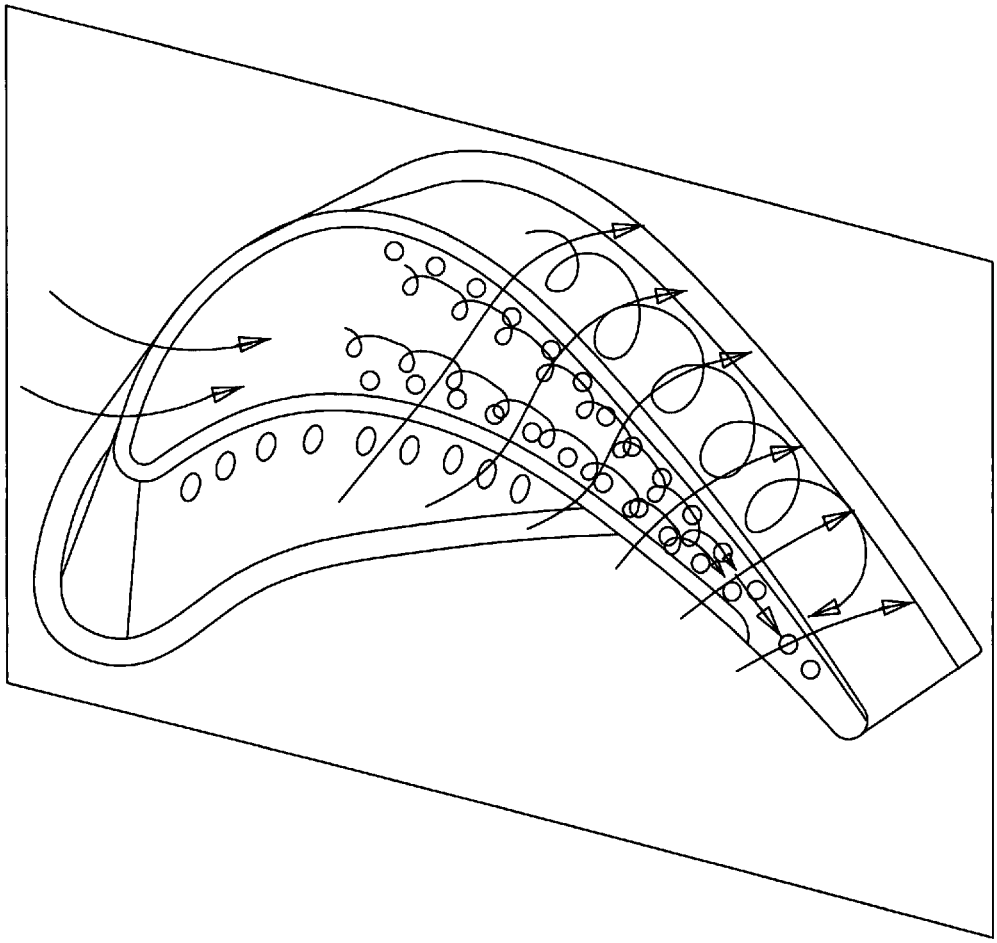
Fig 2 Prior Art
FIG. 2 shows a top view of a prior art turbine blade with a squealer tip.
Figure 3:
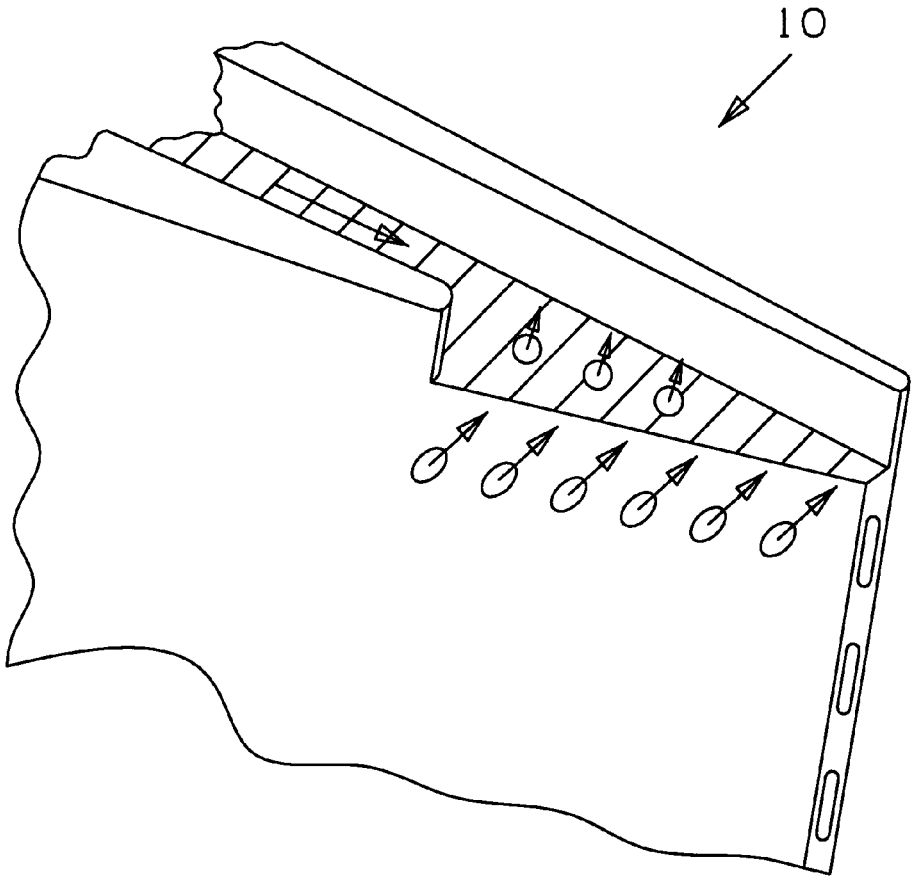
Fig 3 Prior Art
FIG. 3 shows a detailed view of the trailing edge section of the squealer tip of the FIG. 2 prior art turbine blade.

FIG. 1 shows a first stage turbine blade used in an industrial gas turbine engine with the highly effective air cooled turbine blade trailing edge tip corner cooling geometry of the present invention. The blade tip includes a squealer pocket formed by the pressure side and suction side tip rails extending around the leading edge and toward the trailing edge to form the squealer pocket. Rows of film cooling holes are positioned on both the pressure and suction sides of the blade tip region just below the tip rail caps as seen in FIG. 1.

Figure 4:
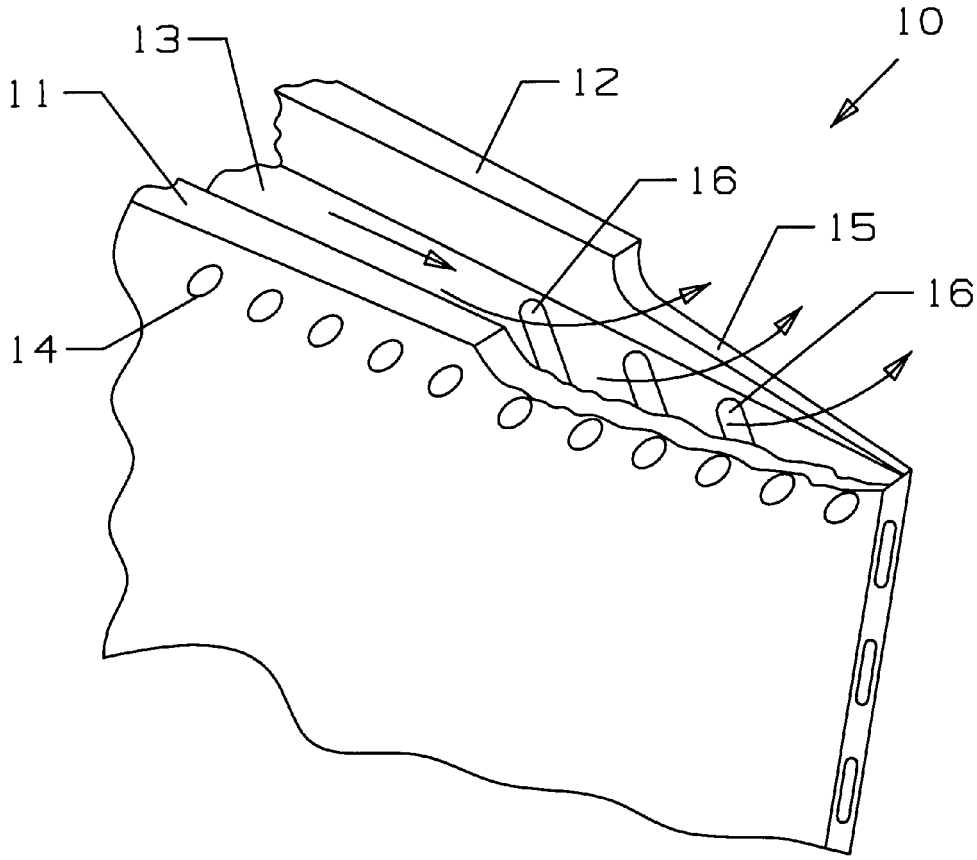
FIG. 4 shows a detailed view of the suction side cut back tip rail of the present invention from FIG. 1.

FIG. 4 shows a detailed view of the trailing edge tip corner cooling geometry used in the present invention. The pressure side tip rail 11 extends all the way to the trailing edge. The suction side tip rail 12 includes a cut back 15 in which a top portion of the tip rail is removed. The suction side cut back 15 is a taper from a normal height of the tip rail to a zero height as measured from the tip floor at the trailing edge of the airfoil. The tip rails 11 and 12 form the squealer pocket with a squealer floor 13. A row of film cooling holes 14 are located on the pressure side of the blade just below the tip rail cap to discharge film cooling air onto the tip rail. A row of film cooling holes are also present on the suction side just below the tip rail cap to also provide film cooling air for the suction side tip rail. A series of skewed trip strips 16 are located on the squealer floor 13 in the trailing edge region in the area of the suction side cut back 15 in order to promote turbulent flow in the cooling air flowing along the pocket floor 13. A portion of the pressure side tip rail has been removed in FIG. 4 to better show the skew trip strips 16 on the squealer floor 13. The pressure side tip rail 11 in this embodiment will extend all the way to the trailing edge. The trip strips 16 are skewed in a direction toward the cut back 15 on the suction side tip rail 12. The skew trip strips 16 can vary in height in the flow direction as well as along the trip strip from suction side to pressure side. The FIG. 4 embodiment shows three trip strips 16. However, more or less can be used depending upon the squealer tip and the trip strip construction. Tip cooling holes can also be used in the squealer floor to discharge cooling air into the pocket. The tip cooling holes can be arranged along the tip rail sides or along the mid-chord of the tip pocket as in any of the prior art tip cooling hole arrangements.

In operation, due to the pressure gradient across the airfoil from the pressure side to the suction side, the secondary flow near the pressure side surface is migrated from the lower blade span upward across the blade end tip. As the secondary leakage flow flows across the blade tip, vortex flow is formed along the inner corner of the pressure and suction tip rails. These vortices are formed primarily of cooling air injected along the squealer pocket next to the tip rails. In addition, due to the pressure gradient these vortices will roll along the tip rail from the airfoil leading edge toward the trailing edge and finally be discharged through the suction side cut back opening on the suction side tip rail. The discharged cooling air is tripped by the skew tip strips formed on the squealer floor of the trailing edge tip end. A higher heat transfer coefficient is therefore created for the blade end tip geometry than that found in the cited prior art references. The cooling flow injection method of the present invention yields a very high cooling effectiveness for the blade end tip cooling and therefore reduces the blade tip section metal temperature. Therefore, the frequent repair of the suction side tip rail during engine overhaul cycle required in the prior art blade tips is eliminated.

I claim the following:

1. A turbine blade for use in a gas turbine engine, the turbine blade comprising:

a squealer tip having a pressure side tip rail extending from a leading edge to the trailing edge of the blade tip and a suction side tip rail extending from the leading edge toward the trailing edge of the blade tip;

a cut back on the suction side tip rail at the trailing edge tip, the cut back forming a cooling flow path from the squealer pocket over the suction side tip rail; and, a series of tip strips formed on the squealer pocket floor and in a location of the cut back to promote turbulence in the cooling air flow.

2. The turbine blade of claim 1, and further comprising:
The series of trip strips are skewed in a direction toward the cut back in the suction side tip rail.

3. The turbine blade of claim 2, and further comprising:
The series of trip strips extend from a location upstream of the cut back in the direction of cooling air flow in the squealer pocket.

4. The turbine blade of claim 1, and further comprising:
The series of trip strips extend from a location upstream of the cut back in the direction of cooling air flow in the squealer pocket.

5. The turbine blade of claim 2, and further comprising:
The series of trip strips extends substantially across the pocket floor from the pressure side tip rail to the suction side tip rail.

6. The turbine blade of claim 1, and further comprising:
The series of trip strips extends substantially across the pocket floor from the pressure side tip rail to the suction side tip rail.

7. The turbine blade of claim 1, and further comprising:
A first row of film cooling holes on the pressure side of the blade and just below the tip rail to discharge cooling air toward the tip rail.

8. The turbine blade of claim 1, and further comprising:
A second row of film cooling holes on the suction side of the blade and just below the tip rail to discharge cooling air toward the tip rail.

9. The turbine blade of claim 1, and further comprising:
A plurality of tip cooling holes on the pocket floor to discharge cooling air into the squealer pocket.

10. The turbine blade of claim 9, and further comprising:
The plurality of tip cooling holes is located upstream from the trip strips in the cooling air flow direction within the squealer pocket.

11. The turbine blade of claim 10, and further comprising:
The plurality of tip cooling holes comprises a row of pressure side tip rail cooling holes and a row of suction side tip rail cooling holes to provide cooling on the inside of the respective tip rails.

12. The turbine blade of claim 1, and further comprising:
The suction side cut back tapers from a top of the tip rail to a bottom of the tip floor.

13. The turbine blade of claim 12, and further comprising:
Substantially all of the taper in the cut back occurs on the end opposite from the trailing edge end.

14. The turbine blade of claim 12, and further comprising:
The cut back begins with a curved portion and then a substantially straight portion that decreases in height in a direction above the tip floor.

15. The turbine blade of claim 14, and further comprising:
The substantially straight portion ends at the trailing edge of the airfoil at the tip floor height.

* * * * *